US006314362B1

(12) United States Patent
Erzberger et al.

(10) Patent No.: US 6,314,362 B1
(45) Date of Patent: Nov. 6, 2001

(54) METHOD AND SYSTEM FOR AN AUTOMATED TOOL FOR EN ROUTE TRAFFIC CONTROLLERS

(75) Inventors: Heinz Erzberger, Los Altos Hills; B. David McNally, Menlo Park, both of CA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/498,123

(22) Filed: Feb. 2, 2000

Related U.S. Application Data

(60) Provisional application No. 60/118,401, filed on Feb. 2, 1999.

(51) Int. Cl.[7] ..... G08B 21/00

(52) U.S. Cl. ..... 701/120; 701/300; 340/961

(58) Field of Search ..... 701/120, 219, 701/300, 301; 340/947, 961, 982, 990, 995; 342/29, 36, 454, 455, 456; 705/6

(56) References Cited

U.S. PATENT DOCUMENTS 5,732,384 * 3/1998 Ellert et al. ..... 701/120
6,020,831 * 2/2000 Nishida et al. ..... 340/945

OTHER PUBLICATIONS

Final Report of the RTCA Task Force 3, Free Flight Implementation, RTCA, Inc., Washington, DC, Oct. 26, 1995.
McNally, B.D., Bach, R.E., Chan, W., "Field Test Evaluation of the CTAS Conflict Prediction and Trial Planning Capability," AIAA 99–4480, Boston, MA, Aug. 10–12, 1998.
McNally, D., Erzberger, H., Bach, R., Chan, W., "A Controller Tool for Transition Airspace," AIAA–99–4298, Guidance Navigation and Control Conference, Portland, OR, Aug. 9–11, 1999.
Erzberger, H., David, T.J., Green, S., "Design of Center–TRACON Automation System," AGARD Guidance and Control Panel 56$^{th}$ Symposium on Machine Intelligence in Air Traffic Management, Berlin, Germany, May 11–14, 1993.
Slattery, R., Zhao, Y., "Trajectory Synthesis for Air Traffic Automation," AIAA Journal of Guidance, Control, and Dynamics, vol. 20, No. 2, pp. 232–238, Mar.–Apr. 1997.
Benjamin, S.G., Brundage, K.J., and Morone, L.L., "The Rapid Update Cycle, Part 1: Analysis/Model Description," Technical Procedures Bulletin, NOAA/NWS, Jun. 16, 1994.
Erzberger, H., Paielli, R.A., Isaacson, D.R., Eshow, M.M., "Conflict Detection and Resolution in the Presence of Prediction Error," 1st USA/Europe Air Traffic Management R&D Seminar, Saclay, France, Jun. 17–20, 1997.
Isaacson, D.R., Erzberger, H., "Design of a Conflict Detection Algorithm for the Center–TRACON Automation System," 16$^{th}$ Digital Avionics Systems Conference, Irvine, CA, Oct. 26–30, 1997.

* cited by examiner

*Primary Examiner*—Tan Nguyen
(74) *Attorney, Agent, or Firm*—Robert M. Padilla

(57) ABSTRACT

A method and system for a new automation tool for en route air traffic controllers first finds all aircraft flying on inefficient routes, then determines whether it is possible to save time by bypassing some route segments, and finally whether the improved route is free of conflicts with other aircraft. The method displays all direct-to eligible aircraft to an air traffic controller in a list sorted by highest time savings. By allowing the air traffic controller to easily identify and work with the highest pay-off aircraft, the method of the present invention contributes to a significant increase in both air traffic controller and aircraft productivity. A graphical computer interface (GUI) is used to enable the air traffic controller to send the aircraft direct to a waypoint or fix closer to the destination airport by a simple point and click action.

22 Claims, 4 Drawing Sheets

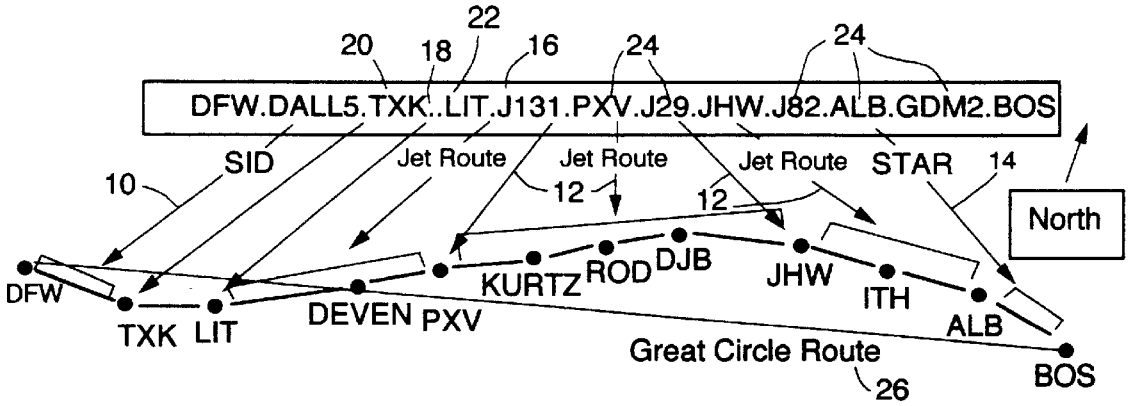
FIGURE 1.
FIGURE 2.
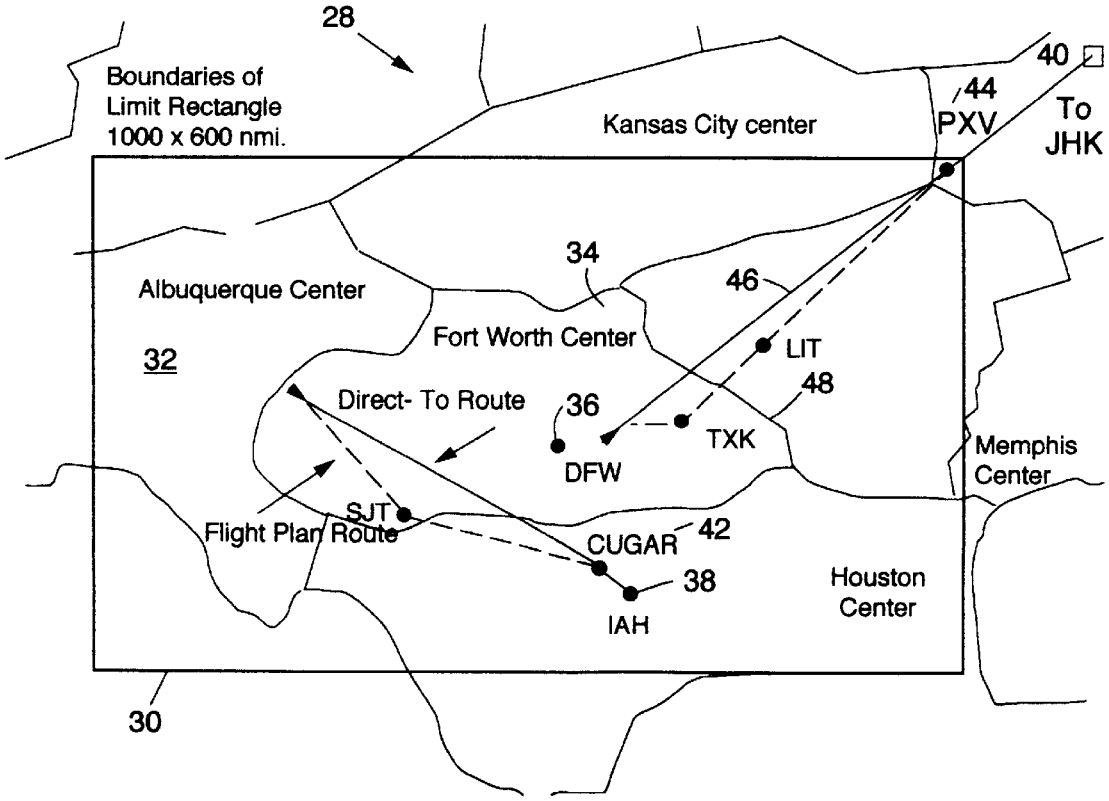

METHOD AND SYSTEM FOR AN AUTOMATED TOOL FOR EN ROUTE TRAFFIC CONTROLLERS

CROSS-REFERENCE TO RELATED APPLICATIONS

This application claims the benefit of U.S. Provisional Application No. 60/118,401, filed Feb. 2, 1999, entitled "A Direct-To Controller Tool", herein incorporated by reference.

ORIGIN OF THE INVENTION

The invention described herein was made by employees of the United States Government and may be manufactured and used by or for the Government for governmental purposes without the payment of any royalties thereon or therefor.

BACKGROUND OF THE INVENTION

1. Technical Field

The present invention is directed toward an improved method and system for first finding all aircraft flying on inefficient routes, then determining whether it is possible to save time by bypassing some route segments, and finally determining whether the improved route is free of conflicts with other aircraft. In particular, the present invention relates to automatically identifying all aircraft eligible for direct-to routes and to determine and display the corresponding timesaving.

2. Description of the Related Art

In recent years, advances in air traffic control have often been evaluated by how effectively they further the goals of "free flight." Although the notion of free flight is difficult to define precisely, any method that reduces constraints and increases the freedom of airspace users to operate aircraft in a manner they consider optimum is considered to be a step toward free flight. Since the notion became popular a number of years ago, numerous innovations, technologies and automation methods have been investigated under the umbrella of free flight. Some of these were recommended for national development by a consensus of airspace users, operators and air traffic control experts. In response to these recommendations, the Federal Aviation Administration established the Free Flight Project Office to lead and execute a deployment effort.

This development effort consisted of evaluating a Conflict Probe/Trial Planner (CPTP) built into the Center TRACON Automation Systems (CTAS) used by air traffic controllers. During the field test of CPTP at the Denver Air-Traffic Control Center, air traffic controllers would usually attempt to resolve conflicts predicted by the CPTP by trial-planning resolution trajectories that led from the conflict aircraft's current position to a down-stream fix along the aircraft's flight plan. In about 20 percent of such attempts, they succeeded in finding trajectories direct to a fix that resolved the conflict. Thus, when this method was successful, the solution had the additional advantage of reducing the path distance to fly to the destination. In the Denver Air Traffic Control Center tests, only aircraft that were "fortunate" to have been identified as being in conflict had the potential to benefit from path shortening direct-to fix trajectories. This finding suggested the following hypothesis: Since conflicts are random events, there must exist a similar percentage of non-conflict aircraft that could reduce their path distances by direct-to fix trajectories. Armed with this knowledge, air-traffic controllers at a follow-on test of CPTP at the Fort Worth Air Traffic Control Center used the Trial Planner to manually search for non-conflict aircraft that could benefit from direct-to fix trajectories. Through trial and error with CPTP they found many aircraft, especially departures from DFW airport, that were eligible for path shortening direct-to fix trajectories.

While effective for finding and resolving conflicts and conflict probing direct routes for any aircraft selected by the controller, CPTP lacked the ability to automatically identify each and every aircraft eligible for direct-to routes and to determine and display the corresponding time savings. To aircraft operators, time saving, which accounts for the effect of winds, and not necessarily path length saving is the appropriate measure of flight efficiency. Therefore, a need exists for adequately and efficiently by an automatic method, identifying all aircraft eligible for direct-to routes and to determine and display the corresponding timesaving. More particularly, a method must be provided to account for the effect of wind patterns in determining whether direct-to routes reduce the time to fly. The subject invention herein, solves these problems in a unique and novel manner not previously known in the art.

SUMMARY OF THE INVENTION

It is therefore an object of the present invention to provide an improved method and system for automatically identifying all aircraft eligible for direct-to routes and to determine and display the corresponding timesaving.

It is yet another object of the present invention to provide an improved method and system that uses a GUI to lower the workload for air traffic controllers in providing direct-to routing to eligible aircraft which has the potential to save in excess of 500,000 in-flight minutes per year in the Fort/Worth center airspace.

The foregoing object is achieved, as is now described, using a method and system for a new automation tool for en route air traffic controller. The method and system of the present invention first finds all aircraft flying on inefficient routes, then determines whether it is possible to save time by bypassing some route segments, and finally it determines whether the improved route is free of conflicts with other aircraft. The method displays all direct-to eligible aircraft to an air traffic controller in a list sorted by highest time savings. By allowing the air traffic controller to easily identify and work with the highest pay-off aircraft, the method of the present invention contributes to a significant increase in both air traffic controller and aircraft productivity. In another preferred embodiment of the invention, a graphical computer interface (GUI) is used to enable the air traffic controller to send the aircraft direct to a waypoint or fix closer to the destination airport by a simple point and click action.

The above as well as additional objects, features, and advantages of the present invention will become apparent in the following detailed written description

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 1 is a graphical representation of a typical flight plan between Dallas/Fort Worth and Boston airports;

FIG. 2 depicts a graphical representation of the airspace within and surrounding the Fort Worth airport center for use with the method of the present invention;

DETAILED DESCRIPTION OF THE PREFERRED EMBODIMENT

Figure 3:
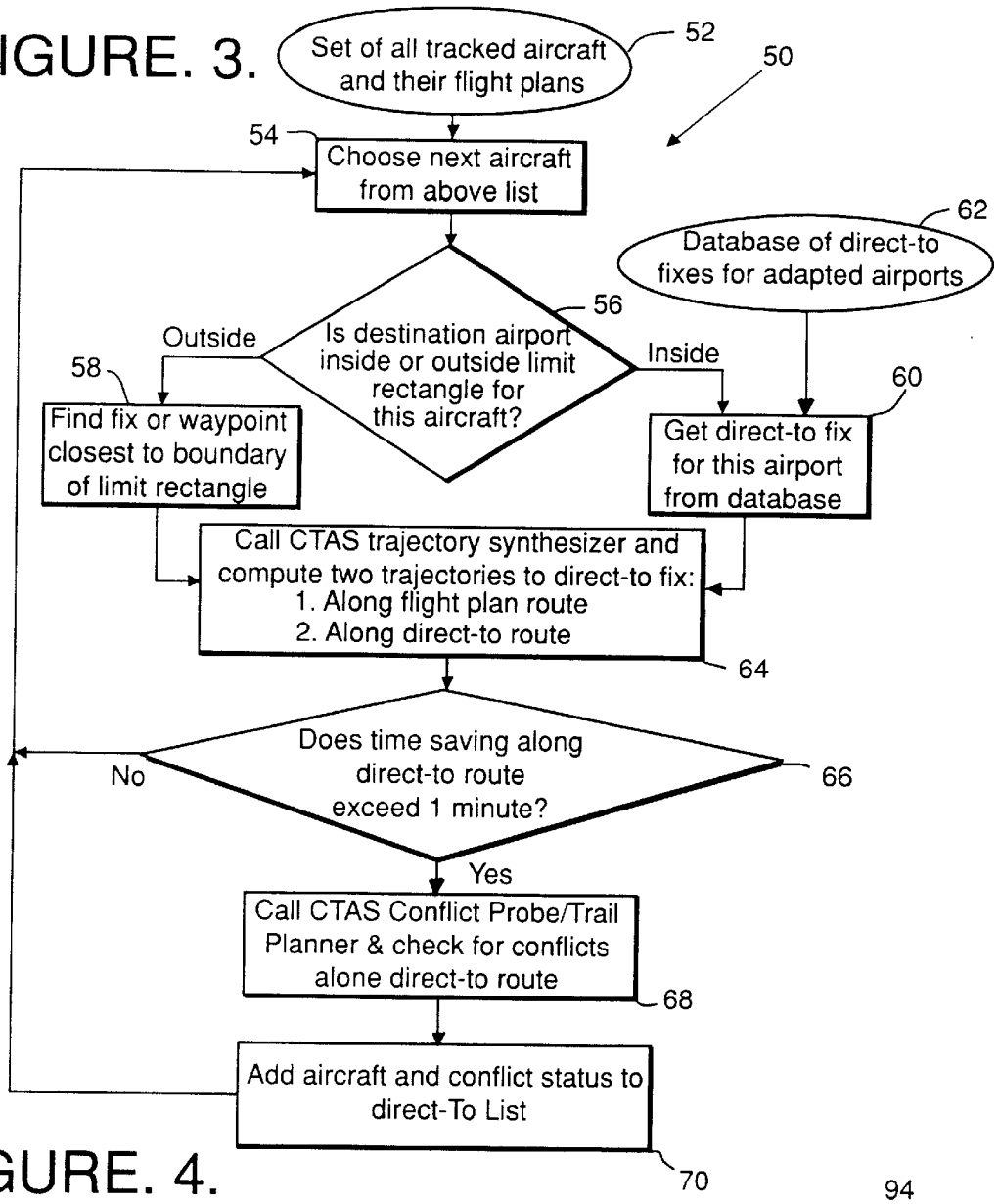
FIG. 3 shows a flowchart for generating the direct-to eligible aircraft and the direct-to fixes in accordance with one preferred embodiment of the present invention.

With references now to the drawings wherein like reference numerals refer to like and corresponding parts throughout. The primary requirement guiding the design of the method and system of the present invention was to improve both controller productivity and aircraft trajectory efficiency within the constraints of the current air traffic control environment. This requirement ruled out dependencies on new infrastructure technologies such as an automated two-way air-ground data link. It also eliminated from consideration the specification of curved or multi-segment trajectories that provide the minimum time to fly to the destination in a spatially varying wind field. Neither the infrastructure of today's air traffic control system nor the navigation equipment on most aircraft support the specification of such types of trajectories to aircraft while in flight.

Moreover, making extensive in-flight routing changes to an aircraft's flight plan requires the controller to specify strings of alphanumeric data to the pilot via voice communications. This approach is impractical for routine use because of its high controller and pilot workload. The use of these more complex techniques will have to await the deployment and integration of new infrastructure, such as the planned air-ground data link.

In view of the constraints described above, the only currently feasible opportunity for increasing the efficiency of aircraft routes in flight with the controller in the loop centers is the use of the so called direct-to clearance. This type of clearance is well understood and is already being used by controllers, usually when requested by pilots, but also at the controller's initiative. The argument or specification parameter in the direct-to clearance is the name of a navigation fix or waypoint contained in the aircraft's flight plan, which are known to both the controller and pilot The spoken form of the clearance is "airline flight 123, fly heading XYZ proceed direct ABC, when able, rest of route unchanged." It directs the pilot to fly to a new heading, taking the aircraft in a straight line from its current position to the specified navigation fix.

In order to explain the need for an automated method of generating direct-to clearances in accordance with the present invention, it is necessary to review briefly the basic structure of flight plans and the routes derived from them. Typically, for an airline flight between major airports, a flight plan consists of three types of concatenated route segments: a standard instrument departure (SID) route, an en route path, and a standard terminal arrival route (STAR). The en route path is defined by a sequence of three letter identifiers for fixes, five letter identifiers for route intersections, and airway identifiers. The geographical coordinates of waypoints are also acceptable entries in a flight plan and may either be specified by their latitude/longitude coordinates or their polar coordinates (angle and distance) relative to a named fix. The latter method is referred to as a fix radial distance (FRD). An example of a typical flight plan between Dallas/Fort Worth and Boston is shown in FIG. 1.

Referring now to FIG. 1, SID's 10, jet routes 12 and STAR's 14 are themselves composed of a series of straight line segments, separated by waypoints. Any flight plan, constructed according to the standardized format, can be parsed into a concatenated sequence of straight line segments, with waypoints separating each segment as illustrated in FIG. 1. Two basic parsing rules are illustrated. Entry and exit points for SID's 10, STAR's 14 and airways, such as J131 16, are defined by fixes whose identifiers are separated from the route identifiers by periods 24. A double period 18, such as between fixes TXK 20 and LIT 22, denotes that a straight line (great circle) route 26 connects the corresponding fixes. When the connected segments of a parsed flight plan are plotted on a map, they can deviate substantially from a great circle route 26, which would give the shortest distance between two points on the earth's surface. This can be seen in FIG. 1 where both the great circle and flight plan routes have been drawn approximately to scale. The difference in path length between the routes was calculated to be 45 nmi. This translates to a difference in flying time of about 6.5 minutes, assuming no winds are present.

In general, as FIG. 1 shows, each of the segments can have a different heading direction, giving a non-linear appearance to the route of flight. Aside from the necessity to avoid weather and restricted airspace, non-direct (non-great circle) routes are used for the following reasons: 1. Limitations in the performance of traditional (non-RNAV equipped) navigation systems based on VOR/DME ground stations. 2. Constraints on departure and arrival routes necessary to achieve an orderly, safe and manageable flow of traffic near large airports. 3. Non-direct routes optimized to take advantage of favorable winds.

Since most flight plans are generated by the flight planning services of airlines before being sent to the air traffic control system, it is not always obvious to a pilot or controller if the efficiency of the flight route can be improved after departure. Because of the significant effect of spatially varying wind fields on time to fly along a specified route, a direct-to clearance to a down-stream waypoint that bypasses one or more route segments in the flight plan could either increase or decrease the time to fly to the destination. Except in obvious situations, neither pilot nor controller has reliable information at hand to guide them in deciding whether a direct-to clearance will increase or decrease flight efficiency. Furthermore, in transition airspace near a terminal area, an aircraft deviating from a departure or arrival route could cause problems and disrupt the orderly flow of traffic.

Therefore in accordance with the present invention a new automation tool is provided for controllers that guarantees an improvement in the efficiency of flight whenever direct-to clearances are issued. The design requirements for such a tool can be summarized as follows: 1. Automated search for and identification of all aircraft that can benefit from a direct-to clearance. 2. Selection of an appropriate fix or waypoint chosen from the aircraft's flight plan that will reduce its time of flight to the destination. 3. Identification of potential conflicts along the direct-to route. 4. An appropriate controller interface for the tool including a method for updating the flight plan A method for generating four dimensional (4D) trajectories provides the analytical and computational engine for use with the tool of the present invention. Four dimensional trajectories predict the future position and altitude of an aircraft along a specified route as a function of time, starting at the current time, position and altitude, and terminating at or near the destination airport. Because a properly computed 4D trajectory incorporates all information that is currently known about an aircraft, including its current state, performance capabilities, climb and descend procedures, flight plan and winds along the route, it provides a method for use by the present invention with the rational basis for comparing the time to fly along alternate routes. 4D trajectories also form the basis for the controller automation tools in the Center-TRACON Automation System (CTAS) currently used by air traffic controllers. Therefore, the 4D trajectory synthesizer in CTAS together with its real time software infrastructure provide a convenient and efficient platform for implementing the method and system of the present invention.

The CTAS software suite offers several advantages as a platform for implementing the present invention. After several years of daily operational use by air traffic controllers at several centers and TRACON's, the CTAS software has reached a high level of accuracy and reliability. In particular, the 4D trajectory synthesizer in CTAS has been upgraded several times, increasing its flexibility, accuracy and speed of computation. The two most important features of the trajectory synthesizer used in implementing the method of the present invention are the ability to rapidly generate multiple trajectories and its method for handling winds. Wind speed and direction, as well as temperature and pressure are modeled as a discretized function of horizontal position coordinates and altitude. These atmospheric parameters are specified typically on a 40 km by 40 km horizontal grid covering all of the continental US airspace.

CTAS receives an update of this atmospheric model from the National Weather Service every hour. The model was developed by the Forecast Systems Laboratory of the National Oceanic and Atmospheric Administration and represents the highest accuracy in mesoscale atmospheric modeling currently available. CTAS interpolates the gridded data for any three dimensional point along the trajectory. The trajectory itself is generated by a complex process using a second order Runge-Kutta variable step size integration method. Accounting for the wind field as implemented in CTAS is essential to the method of the present invention, since comparison of time to fly to a fix along two different routes is at the heart of its operation.

For each aircraft eligible for a direct-to clearance, the CTAS trajectory synthesizer will compute the time to fly to a fix in the route of flight and to the same fix along the direct-to route, whereupon a comparison of the times to fly will determine whether the aircraft is eligible for a direct-to clearance. However, before the trajectories can be computed and the comparison made, it is first necessary to determine a method for choosing the direct-to waypoint from the potentially large number of waypoints in the flight plan. One such method would be to always choose the destination airport itself or a waypoint near the airport, such as a feeder fix, as the direct-to fix. While this method is appropriate for some destination airports, it would give erroneous results if applied to airports several thousand nautical miles away, and especially for transoceanic and transpolar flights. Such distant airports are likely to be located outside the area covered by the wind model used in CTAS. For those airports the CTAS trajectory synthesizer would generate grossly inaccurate times to fly, providing misleading advisories to controllers. Another problem with using direct-to routes to fixes more than approximately a 1000 nmi away is that their use would have to be restricted to aircraft equipped with advanced avionics such as inertial navigation or GPS systems. Finally, direct-to routes to some distant hub airports would frequently run counter to air traffic control procedures in effect in the en route airspace feeding these airports. So in consideration of these problems and in observance of the cardinal rule of automation to do no harm, it is necessary to limit the range of the direct-to fixes generated.

Several methods exist for limiting the range of the direct-to fixes. One method would limit the range to a maximum distance relative to the current position of the aircraft; for example, 500 nmi downrange. A second method would limit the reduction of the time to fly to a specified maximum; for example 8 minutes, thereby implicitly limiting the ranges to the direct to fixes. A third method would limit the choice of the direct-to fixes to a specified region of airspace surrounding an enroute center. In accordance with one preferred embodiment of the invention, the airspace method (third method) provides the primary control over the range of the direct to fixes. But, the second method which limits the time savings (eight minute is used in the current system), is also incorporated to provide additional control.

Referring now to FIG. 2, there is depicted a graphical representation of the airspace 28 within and surrounding the Fort Worth airport center for use with the method of the present invention. To implement the airspace method, a limit rectangle 30 is defined that restricts the choice of direct-to fixes to the interior of the rectangle 32. The rectangle 30 is oriented along North-South and East-West directions and is centered on or near the geometric center of the home Center 34 where the tool of the present invention is installed. At the Fort Worth Center 34, for which the tool of the present invention was designed, it is centered on the Dallas/Fort Worth airport 36 and its dimensions are 1000 nmi East-West and 600 nmi North-South. An alternative to the rectangle method is to limit the location of the direct-to fixes to the combined airspace of the home Center and all adjacent Centers surrounding the home Center, the so-called first-tier Centers. The rectangle 30 has the advantage of being simple to implement and computationally efficient. At each Center where the Tool is installed, the limit rectangle parameters, which determine the location of the center and the dimensions of the rectangle, must be chosen appropriately by taking into account the unique shape and size of a Center's airspace. Furthermore, the choice of limit rectangle parameters is influenced by the need to include particular fixes located in adjacent Centers which air traffic controllers frequently offers to pilots as direct-to fixes.

The next step is to develop the appropriate list of direct-to fixes for airports located within the limit rectangle 30. It was determined that the choice of nearest direct-to fixes for an airport depends on the traffic density and airspace structure of the destination airport. For low density airports surrounded by low activity airspace, the airports themselves may be used as the direct-to fixes. For large airports where arrival aircraft approach via STAR's and cross into the TRACON airspace at feeder gates, fixes or waypoints along the STAR's must be selected to be the direct-to fixes. The selected fixes must comply with facilities'internal procedures and not violate any letters of agreement between Center and TRACON. Thus, in preparing the Tool in accordance with the present invention for operational use at a Center, a database must be created containing the set of appropriate direct-to fixes for as many airports as possible within the limit rectangle 30. Airports included in this database are referred to as the adapted airports. At this time, the initial implementation of the present invention excludes arrivals into the main hub airport within a Center, such as the DFW airport 36 within the Fort Worth Center 36. For the tool of the present invention to handle such arrivals it is necessary to incorporate arrival metering delays and airport arrival rate restrictions into the decision process. This information is readily available within CTAS's Traffic Management Advisor (TMA).

Turning once again to FIG. 2, direct-to routes for two flights are illustrated for the airspace within and surrounding the Fort Worth Center 34 and one for a flight to Houston Intercontinental Airport (IAH) 38 located inside the rectangle 32, the other for a flight to Boston 40 located far outside. The adapted direct-to waypoint for the IAH 38 bound flight is CUGAR 42, which lies on the CUGAR6 arrival route. The farthest allowed direct-to fix for the Boston-bound flight was found to be PXV 44 located just inside the limit rectangle 30 near the North-East corner. When an aircraft on a direct-to route to a fix in a downstream (adjacent) Center equipped with the Tool enters that Center's airspace, the aircraft again becomes eligible for another direct-to route clearance. That is, as soon as the aircraft is tracked and accepted by the adjacent Center, the method of the present invention tests the aircraft for direct-to route eligibility based on the limit rectangle 30 adapted for that Center. For example, this would occur when the DFW to Boston flight, currently eligible for a direct-to route 46 to PXV 44, as illustrated in FIG. 2, reaches the Memphis Center boundary 48. The process of re-testing and possible direct-to re-routing repeats in every Center traversed by the aircraft until it reaches its destination Center. Thus, an aircraft on a transcontinental flight could receive several direct-to's, each of limited range but each contributing incrementally and additively to improved flight efficiency.

FIG. 3 shows a flowchart 50 for generating the direct-to eligible aircraft and the direct-to fixes in accordance with one preferred embodiment of the present invention. As shown in step 52, the method of the present invention requires access in real time to the set of all aircraft being actively tracked by the radar sensors and surveillance system of the Center where the Tool of the present invention is installed. For each tracked aircraft, its identification symbol, together with its current position, velocity, altitude, flight plan and aircraft type must be provided at the update rate of 12 seconds which matches the track update rate of the Host computer. This information is available in CTAS when it is installed at a Center. Proceeding to step 54 each aircraft is tested in this set sequentially, repeating the test at 12 second intervals, which is standard for CTAS's en route tools. The first test after an aircraft has been chosen from the set determines if its destination airport is inside or outside of the limit rectangle as shown in step 56. If outside, it tests each fix/waypoint in step 58 on the flight plan in succession, starting at the next waypoint to which the aircraft is headed, to find the one closest to a boundary of the limit rectangle, thereby establishing the direct-to fix. If inside, it retrieves in step 60 the direct-to fix from the adaptation database 62 by specifying the destination airport and arrival route. Then the method of the present invention in step 64 requests the CTAS 4D trajectory synthesizer to generate two trajectories to the computed direct-to fix, one along the flight plan route, the other along the direct-to route.

Next, the times to traverse each route, obtained from the 4D trajectories, are compared in step 66. If the direct-to route saves at least one minute, that aircraft's ID will be added to the controller's Direct-To List; to be described below. The one minute criterion was chosen because it represents the quantum of time saving considered significant in airline operation, and also to limit the number of aircraft in the List. If the time saving is less than one minute, the aircraft is eliminated, but it will be re-tested again in the next update cycle by returning to step 54. In the next to last step 68, an aircraft that has passed the time saving test successfully is tested for predicted conflicts by CTAS's Conflict Probe/Trial Planner function against all other actively tracked aircraft that are known to CTAS. Lastly, in step 70 the method of the present invention updates the list by adding the newly found direct-to eligible aircraft and its predicted conflict status to the List. Thereafter, the method returns to step 54 to choose the next aircraft to be tested for direct route eligibility. It should be mentioned that the conflict probing is performed with the conflict alert parameters set to 12 nmi horizontal for all aircraft and 4000 ft vertical separation for transition aircraft. These are significantly larger than the regulatory limits of 5 nmi and 2000 ft. The extra margin gives the air traffic controller, who is responsible for issuing the clearance, increased confidence that the direct-to route will be problem free for down-stream controllers. In the CTAS Conflict Probe, the alert parameters are adjustable and therefore can be adapted to meet the requirements of each facility. The newly discovered direct to eligible aircraft, together with its time saving, direct-to fix identifier, conflict status and certain other information are now added to the Direct-To List.

In another preferred embodiment in accordance with the present invention, when the tool is implemented in CTAS, it can accommodate two enhancements that will further increase the efficiency of the direct-to trajectories. One is to extend the search for the best direct-to fix to more than one fix. By computing trajectories to several candidate fixes lying within the limit rectangle, it is possible to identify the fix that produces the greatest time saving. The second enhancement is to evaluate the effect on time saving when the cruise altitude is changed one or more levels above and one or more levels below the current cruise altitude. This will identify the altitude level where winds are the most favorable. While these enhancements will increase the computational load, they are considered feasible to implement, because the multiprocessor architecture of CTAS's trajectory engine was designed to handle this load and is doing so successfully in supporting the operation of other CTAS Tools with similar requirements.

Figure 4:
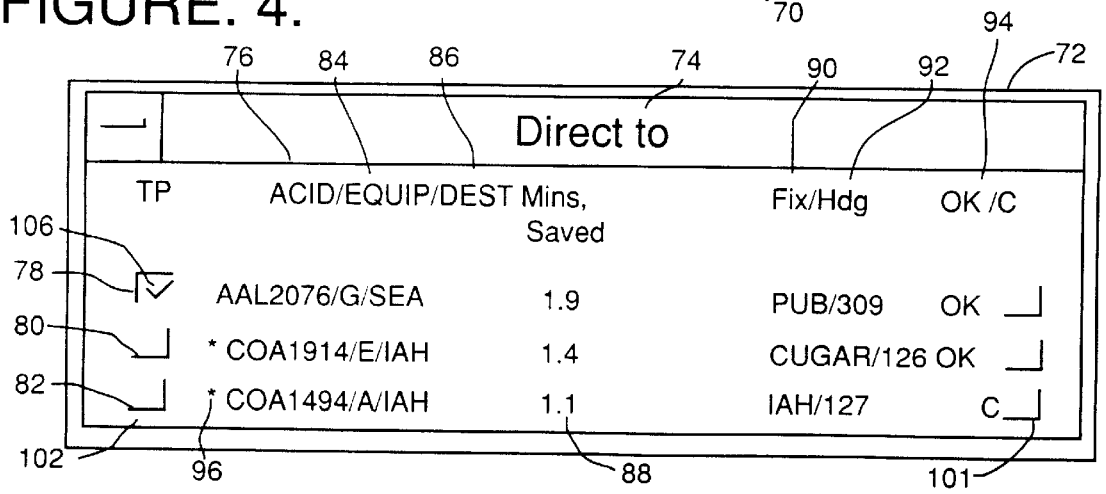
FIG. 4 shows a screen photo of a graphical user interface for displaying direct-to eligible aircraft and corresponding time savings in accordance with another preferred embodiment of the present invention.

Referring now to FIG. 4, there is shown a screen photo of a controller interface 72 for displaying direct-to eligible aircraft and corresponding time savings in accordance with another preferred embodiment of the present invention. It employs a graphical user interface similar to software running on workstations and personal computers and has been designed to be accessible from the controller's display monitor. With the controller interface 72, the air traffic controller (not shown) selects items from menus and sends flight plan amendments from the controller display to a Host computer using point-and-click actions executed with a mouse or track ball. Using the controller interface 72 with the CTAS Conflict Probe/Trial Planner using a point-and-click graphical user interface minimizes, if not altogether eliminates, the time-consuming keyboard entries currently in use. For a Tool such as this, whose use is not safety-critical but is essentially voluntary, a friendly and low workload interface provides the main incentive for air traffic controllers to use it. The Tool interface consists of a Direct-To List, point-and-click executable commands, and graphical display of trajectories.

The Direct-To List 74 appears as a panel on the controller's display and is illustrated in FIG. 4. The first, and most important, items in the List are the aircraft call signs 76 (ACID's) of all aircraft which the method of the present invention has determined are eligible for direct-to clearances. Only those eligible aircraft currently "owned" by the controller of a specific sector are displayed in the panel. The eligible ACID's 76, if there are more than one, are ordered by the amount of potential time saving, with the ACID's 76 having the highest time saving shown at the top of the List 74. The List 74 is refreshed and reordered every 12 seconds. This time interval corresponds to the refresh cycle of trajectory computation in CTAS. In the typical evolution of this List 74, an aircraft initially appearing near the top of the list migrates gradually toward the bottom with each update cycle. The aircraft is removed from the List 74 either when the potential time saving has become less than the threshold value of one minute or as a consequence of the controller having issued a direct-to clearance that reduces the time saving to less than one minute.

In addition to the ACID 76, the List 74 contains other essential information to assist the controller in deciding whether to issue a direct-to clearance for an eligible aircraft and, if so, what type of clearance to issue. FIG. 4 shows a screen photo of a Direct-To List containing three eligible ACID's, 78, 80 and 82, respectively. As illustrated in FIG. 4, the aircraft equipage code 84 and the destination-airport identifier 86 follow the ACID 76 and are separated from each other by slashes. The equipment identifier 84 tells the controller the type of navigation equipment carried by that aircraft. Seventeen types, each identified by a letter code, are recognized in air traffic control. The three shown in FIG. 4, (G, E, A) refer to GPS equipped, flight management system equipped, and conventionally equipped, respectively. The controller uses the equipage code 84 to determine the type of clearance to issue. For example, an A-equipped aircraft, the least sophisticated of the three, will generally require the controller to issue both a heading direction and a navigation fix as part of the direct-to clearance. On the other hand, for aircraft with E, G or certain other equipage codes, the controller need specify only a navigation fix to the pilot when issuing the direct-to clearance.

The next field 88 gives the amount of time saving, in minutes, provided by a direct-to trajectory, compared to the currently planned trajectory. When there are several aircraft in the List 74, comparison of time savings helps the controller prioritize the order in which to issue direct-to clearances. For example, during periods of high workload, she may only have time to issue one or two direct-to clearances. In that case, issuing direct-to clearances to aircraft with the highest potential time savings will maximize the controller's productivity. The next field gives the identifier 90 of the direct-to fix computed by the method of the present invention and the heading 92 to that fix, separated by a slash. As explained in the preceding section, the direct-to fix is always a fix along the route of flight and located down-stream from the current position of the aircraft. The heading angle is the magnetic heading and is corrected for wind speed and direction. Thus, it is the magnetic heading that the aircraft must fly starting at the current position in order to be on course to cross the fix. The fix identifier and the heading provide the information the controller needs to issue the clearance to the pilot.

The next to last field 94 gives the predicted conflict status of the aircraft along the proposed direct-to trajectory. An "OK" indicates no conflict, whereas a "C" indicates a conflict is predicted. Furthermore, on the color monitor where the List 74 is displayed, the conflict status symbols are color-coded to enhance recognition, with "OK" drawn in green and "C" in red. Observation shows that aircraft are predicted to come into conflict along the direct-to route infrequently, and that only about one in ten aircraft ever show a conflict at any time while they are on the List 74. When several aircraft appear on the List 74, some with and some without conflicts, the controller could initially skip aircraft with conflicts and work only with the conflict-free aircraft. Then, when the conflicts have cleared, as they frequently do after a short time, the controller can consider issuing direct-to clearances, to these, now conflict-free, aircraft.

The addition to showing predicted conflicts for the direct-to routes, the List 74 also uses a symbol, a red asterisk (*) 96, located to the left of the AICD 76, to indicate if the direct-to eligible aircraft is in conflict on its current flight plan route. In FIG. 4, asterisks indicating such conflicts are shown for COA1914 80 and COA1494 82, the second and third ACID's on the List. The asterisk 96 essentially serves to cross-reference ACID's 76 which are simultaneously present in the Direct-To List panel 74 and the CTAS Conflict Prediction panel 100. This is illustrated in the screen photo of the controller's display 98 shown in FIG. 5, where both panels are found at the top of the photo 98. The Conflict Prediction panel 100 is the controller's interface to the CTAS Conflict Probe. It lists all pairs of aircraft in a region of airspace which the conflict search algorithm predicts will violate specified separation criteria within a search time horizon.

Checking for the presence or absence of the two categories of predicted conflicts helps the controller make the most timely and productive choice of the next direct-to eligible aircraft To demonstrate how this is done, consider the situation illustrated in FIG. 4 by the third aircraft in the List 74, COA1914 82. This direct-to eligible aircraft is predicted to be in conflict along its current (non-direct) route, as indicated by the asterisk 96, but is predicted to be conflict-free along the proposed direct-to route. A controller recognizing this situation would have a high incentive to choose this aircraft since a direct-to route amendment issued to this aircraft not only reduces flight time but also resolves the predicted conflict in a single clearance. For the situation where both categories of conflict are predicted, as for COA1494 82 in FIG. 4, the choice is not as unambiguous as was the previous case but still may be worthy of investigation by trial planning. For example, the controller may be able to resolve the conflict by choosing a different direct-to fix or a different cruise altitude and still achieve some reduction in flight time. The last field is a square button 101, used to delete a direct-to entry from the Direct-To List panel. For example, a controller may wish to delete an aircraft from the List 74 because that aircraft's route includes a necessary detour around a region of severe weather.

It should be noted that Controllers, who have evaluated the List in shadow mode with live traffic from the Fort Worth Center, do not consider the conflict status as the definitive accept/reject criterion for issuing a direct-to clearance. Instead, they base their decision to issue a direct-to clearance on their overall assessment of the traffic situation, their knowledge of the airspace as well as the conflict status shown in the List. These controller opinions reflect a basic characteristic of this or any decision support tool, namely that the information provided by the Tool is advisory only and as such is not a substitute for good controller judgment. Thus, the controller should always augment the advisory information provided by the Tool with her analysis of the traffic situation before issuing a direct-to clearance.

Referring once again to FIG. 5, there is shown a graphical presentation of an air traffic controller's displays for the Dallas/Fort Worth airspace using the method and system of the present invention. In order for the controller to access additional information on aircraft in the List 74 and to simplify making flight plan amendments, the Direct-To List 74 and the CTAS Trial Planner 104 have been interconnected through an on-screen button in the Direct-To List 74. The button 102, in the form of a small square, is located to the left of each ACID 76 in the List 74 as shown in FIG. 4. The button 102 is a select/deselect switch that puts the corresponding aircraft into the trial planning mode when it is clicked with the mouse into the select position. A check mark 106, as shown for the first ACID 76 on the List 74 in FIG. 4, indicates that the corresponding aircraft has been selected for trial planning.

Figure 5:
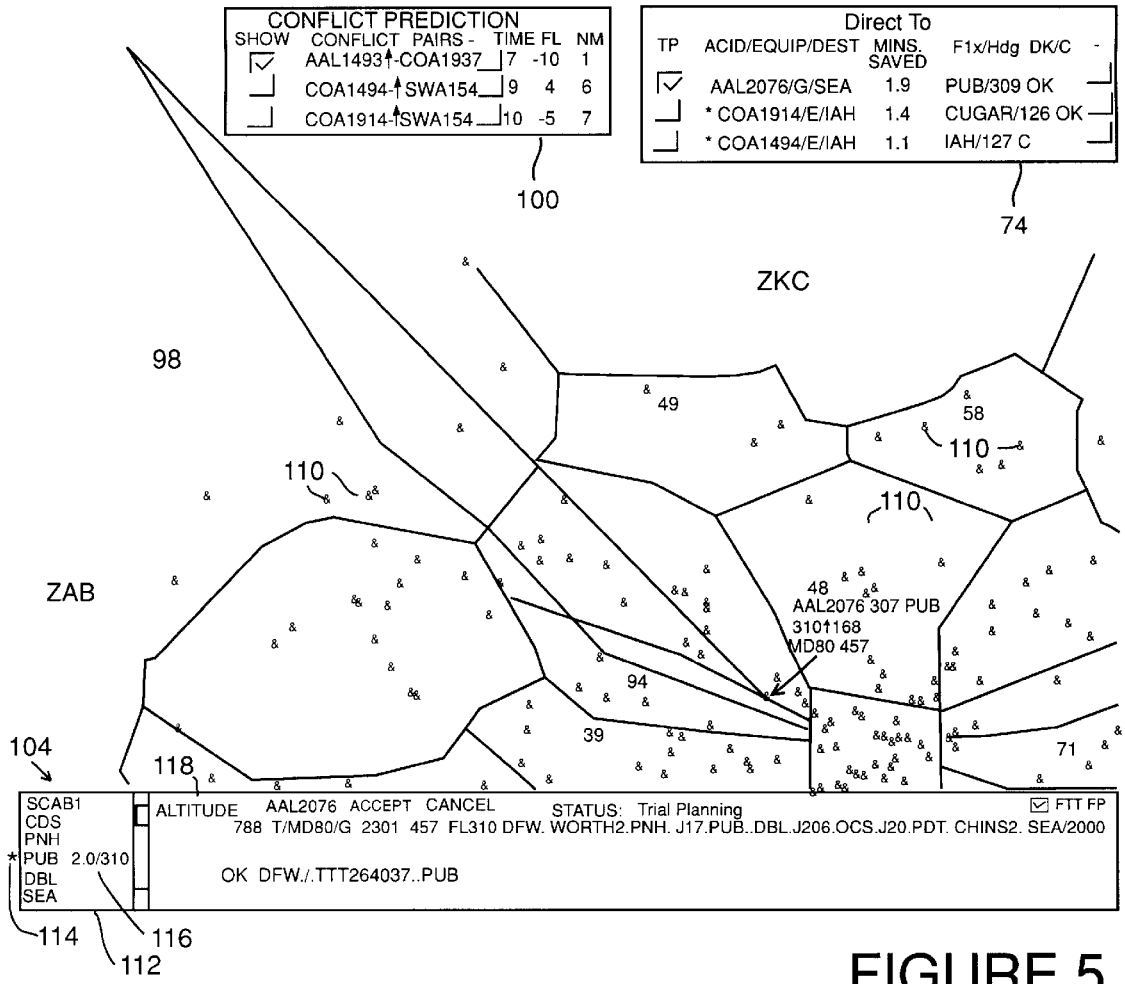
FIG. 5 is a graphical representation of an air traffic controller's displays for the Dallas/Fort Worth airspace using the method and system of the present invention.

The Trial Planner 104 provides the controller with special tools and interactive graphics for managing the trajectories of aircraft in climb, cruise, and descent. With few exceptions, all interactions with the Trial Planner 104 are lo conducted by point-and-click actions with the mouse (or trackball). Thus, "heads down" keyboard entries are almost entirely eliminated. Conflict probing using the CTAS conflict detection algorithm is an integral part of the Trial Planner 104. The Trial Planner 104 allows the controller to put any aircraft, not just aircraft in the Direct-To List 74, in trial planning mode. When the controller selects an is aircraft from the Direct-To List 74 for trial planning by clicking on the select button 102, additional information appears on the screen. A representation of the controller's display 108 covering the North-West quadrant of the Fort Worth Center airspace is shown in FIG. 5 when trial planning a direct-to route for flight AAL2076. The ampersands 110 (&) designate the location of other traffic. Both the flight plan route and the direct-to route are displayed for this flight The panel 104 at the bottom of the screen displays the complete flight plan. At the bottom left, a menu 112 lists the fixes and waypoints in the flight plan that may be used as alternate direct-to fixes. The direct-to fix selected by the algorithm (PUB) is marked by an asterisk 114 in the menu 112. The time saving (2.0) and the heading to the fix (310) are also displayed 116 adjacent to the fix. The area labeled altitude at the bottom left and adjacent to the waypoint menu is a menu button for selecting altitude trial planning. It is clicked on when an altitude amendment is required in addition to the direct-to route amendment.

Referring once again to FIG. 5, to the right of the altitude button 118 are several lines of information pertaining to the aircraft selected for Direct-To trial planning. The first line contains the ACID and buttons to Accept and to Cancel trial planning. The second line contains the current flight plan. The third line (shown blank in the figure) is reserved for displaying the ACID and its flight plan of an aircraft predicted to be in conflict with the aircraft selected for trial planning. The bottom two lines pertain to the trial plan. The first bottom line contains the trial Flight Plan, including the proposed direct-to route amendment. The second bottom line, (shown blank in the figure) would show the ACID and flight plan of an aircraft predicted to be in conflict with the selected direct-to aircraft along its trial direct-to route. Both conflict lines are blank in the figures because neither type of conflict was detected for the trial direct-to aircraft. Both the trajectory display graphics and the information in the trial planning panel are identical to that in the CTAS Conflict Probe/Trial Planner system. If a conflict is predicted along the direct-to route, then the conflict ACID together with pertinent conflict information is also included in the flight plan panel (not shown in FIG. 5 because no trial planning conflicts were found). This information is identical to that in the CTAS Conflict Probe/Trial Planner display.

The content and arrangement of the information shown on the screen has been designed to tell the controller at a glance whether to accept or reject the direct-to route amendment. If her decision is to accept, then the controller need only click on the "accept" button in the panel in order to amend the flight plan. This action sends the direct-to flight plan amendment message from CTAS into the Center's Host computer. Under normal circumstances, the only actions required by the controller in executing a direct-to route amendment consist of two consecutive mouse points and clicks. This simple procedure contrasts sharply with the multiple keyboard entries required by the current operational system to execute direct-to route amendments, referred to as the 6-7-10 amendments, route key amendments or field 10 amendments.

The Trial Planner 104 provides the ability to evaluate and select any one of numerous alternatives to the trajectories generated by the direct-to algorithm. For example, the controller can select any fix/waypoint along the route of flight as the direct-to fix by clicking on the appropriate fix identifier in the fix/waypoint menu. The Trial Planner 104 will check the new direct-to trajectory for conflicts and update the corresponding time savings, fix identifier and heading angle displayed in the Direct-To List 74. Controllers found the ability to easily change the direct-to fix to be a useful feature, especially when the direct-to trajectory shows a conflict. These conflicts can sometimes be resolved by choosing a direct-to fix that is either up-range or down-range of the advised direct-to fix or it may be resolved by creating an auxiliary waypoint, or adding an altitude amendment. In summary, the integrated capabilities of the Direct-To List 74 and Conflict Probe/Trial Planner 104 provide an effective environment by increasing controller productivity and reducing workload.

A prototype of the Tool in accordance with the present invention, consisting of the flowchart methodology described above and controller interfaces, has been implemented as a new software process that is integrated into CTAS. The new process is an extension of the Conflict Probe/Trial Planner, which was evaluated extensively in simulation and field tests at the Denver and Fort Worth Center. Since completion of the basic software, the Tool has been running in shadow mode using the live input of the all flight plan/all tracks data stream received in the CTAS laboratory at NASA Research Ames Center from the Fort Worth Center over a high speed data link. In the shadow mode, the CTAS software receives the same input data in real time from the Center's Host computer system as does the version of CTAS that is in daily use by controllers at the Fort Worth Center. The difference is that in the shadow mode, CTAS only receives data from the Host; it does not send data back into the Host, as it does when used operationally. As was the case for the earlier CTAS tools, shadow mode evaluation of the method and system of the present invention has proven to be an efficient and indispensable method for validating the software and for developing and refining the controller interface. By identifying direct-to eligible aircraft automatically, checking their conflict status and simplifying the flight plan amendment process, the Tool complements as well as amplifies the controller's desire to provide good service. Finally, controllers recognize that the Tool's ability to compensate for the effects of complex wind fields ensures that direct-to routes will be issued only to aircraft that can actually benefit from them. Working without this Tool, controllers cannot be certain that this will be the case.

The most important result obtained from shadow operation of the Tool is an estimate of total time saving for all aircraft operating in a Center's airspace. The overall measure of benefits is chosen to be the accumulated number of minutes of flight time that could be saved in an interval of time when the Tool is in operation. To obtain this measurement, a software function was incorporated into the Tool that records the total minutes saved for all aircraft that are displayed in the Direct-To List. With the Tool running for several months, 24 hours a day, a large amount of benefits data was collected and analyzed for the Fort Worth Center's airspace.

Figure 6:
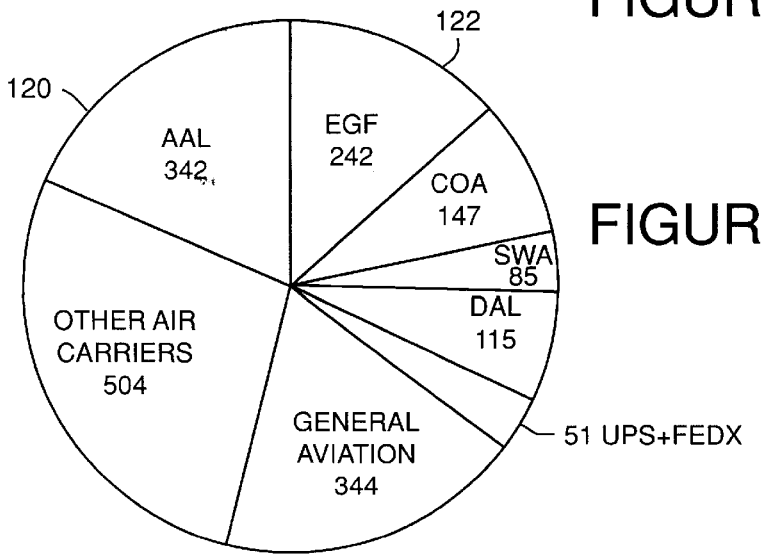
FIG. 6 shows a pie chart representation of the daily saving results in minutes for several different categories of aircraft when implementing the method of the present invention for the Fort/Worth center airspace.

A useful way of analyzing the data is to calculate the average, daily (24 hours) time savings. For the Fort Worth Center, the savings were found to be about 1800 minutes/day, which extrapolates to 657,000 minutes per year. The recorded data also permitted the time savings to be computed separately for each airline and for all general aviation aircraft. The pie chart in FIG. 6 shows the results in minutes of daily savings for several categories. It can be seen that American Airlines (AAL) 120 and its regional affiliate, American Eagle (EGF) 122, benefit the most, reflecting the fact that they are the dominant air carriers and air taxi serving the Dallas/Fort Worth Airport. The savings for several other carriers and for all general aviation aircraft are also shown. The average time saving per direct-to clearance was found to be about 2.5 minutes. By assuming that the direct operating cost per flying minute for air carriers is $35, the yearly cost savings for all air carriers operating in the Fort Worth Center are estimated to be $18,000,000. This estimate excludes potential savings for arrivals into the DFW airport.

The maximum number of aircraft appearing in the List at any time varies between 10 and 20. That number is generally less than 10% of all aircraft operating in the Fort Worth Center at any time. When these aircraft are divided among the sectors who have ownership of them, the maximum number on the List for any sector will seldom exceed 2–3 aircraft in a 20 minute interval. The increase in workload on controllers to issue the additional clearances for these relatively few aircraft is mitigated by the effectiveness of the point-and-click interface and therefore does not raise a concern with controllers. So far, the measurement and analysis of benefits for the Tool have centered on the potential for time savings. It should also be noted that the reduction in the time to fly along a more efficient route also reduces the fuel consumption, provided that the pilot holds the airspeed fixed at the planned value. If an aircraft operator is indifferent to the time saving produced by the direct-to clearance or does not wish to arrive earlier than required by the schedule, then the pilot can trade all or any portion of the time savings for additional fuel savings by reducing the planned airspeed appropriately. Fuel consumption is reduced by flying at a lower airspeed because the planned cruise speed of an aircraft is usually well above the airspeed where fuel consumption is minimized. Thus, the additional degree of freedom offered by the ability to trade time savings for additional fuel savings implies that direct-to advisories generated by the Tool are generally cost effective and operationally advantageous as long as they do not violate safety constraints.

Figure 7:
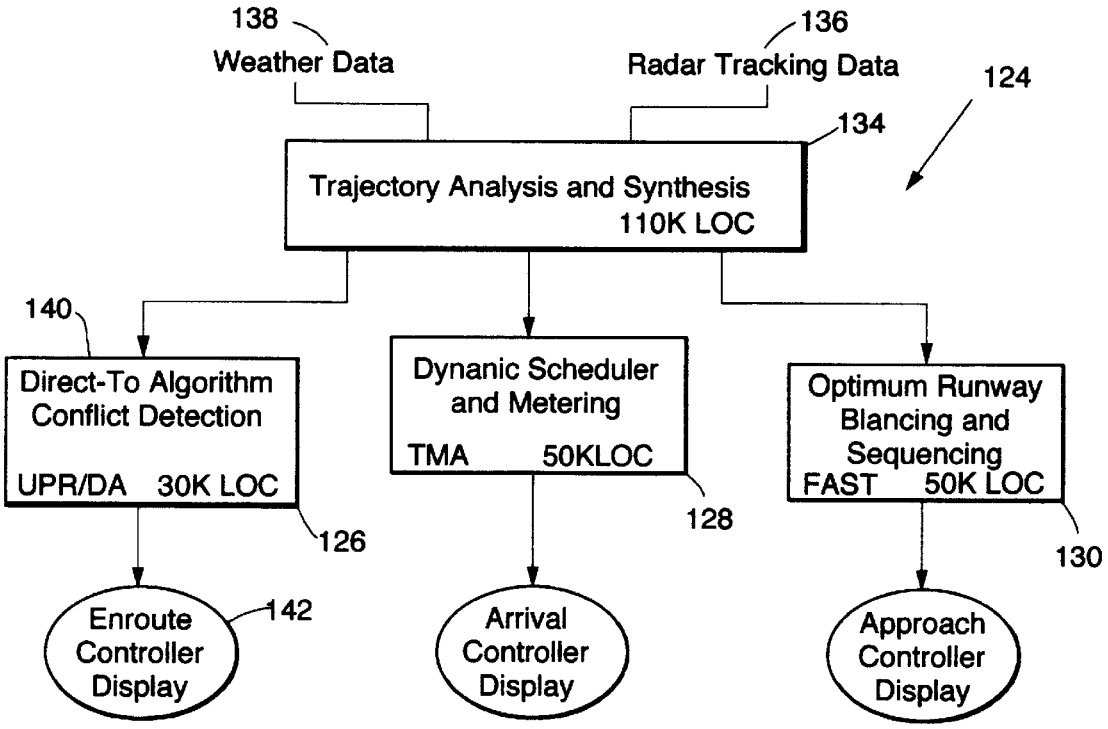
FIG. 7 shows a graphical diagram of how the method and system of the present invention is integrated into an air traffic controller system.

A block diagram of CTAS and the integration of the present invention into CTAS is illustrated in FIG. 7. The diagram 124 is a simplification of the actual software architecture in that it does not explicitly show the communications-oriented processes or their interactions with the processes shown in the FIG. 7. Each of the blocks 126, 128, 130 and 134 represent a separate UNIX processes, which may be run on separate workstations or processors. The key process used by the present invention as well as the other CTAS tools, TMA and FAST, is the Trajectory Analysis and Synthesis module 134. This module 134 generates predicted four dimensional trajectories for every aircraft for which radar tracking data 136, flight plans and three-dimensional gridded wind data 138 are provided as input to the module 134. The number of processors dedicated to this module 134 can be scaled to the maximum number of aircraft that must be handled. For a single en route center with a maximum aircraft count of about 400, four processors are adequate to update the four dimensional trajectories required by the present invention at a rate of once every 12 seconds. The output of this module, consisting of a stream of periodically updated trajectories is sent to the module comprising one element of the present invention. This block, labeled Direct-To Algorithm Conflict Detection 140 in FIG. 7, contains the method for generating the Direct-To List and conflict detection data comprising the present invention. Finally, the information generated in this block is sent to the En Route Controller Display 142, also referred to as the Graphical User Interface or GUI.

It is also important to note that although the present invention has been described in the context of fully providing an improved method and system for automatically identifying all aircraft eligible for direct-to routes and to determine and display the corresponding timesaving, those skilled in the art will appreciate that the mechanisms of the present invention are capable of being distributed as a program product in a variety of forms to any type of information handling system, and that the present invention applies equally regardless of the particular type of signal bearing media utilized to actually carry out the distribution. Examples of signal bearing media include, without limitation, recordable type media such as floppy disk or CD ROMs and transmission type media such as analog or digital communications links.

The design and operational use of the Tool of the present invention represents a proactive approach to problem solving in that it actively searches for and points out opportunities for improving the efficiency of trajectories to controllers. This approach contrasts with the reactive approach embodied in the design of a Conflict Probe which alerts controllers only when problems are predicted to occur. The proactive approach to the design of the present invention extends to the en route airspace what the several CTAS tools have done for the management of arrival traffic. The commonality existing between the method of the present invention and the other CTAS tools not only includes the design philosophy but, more importantly, also includes the trajectory algorithm, software and system architecture. This makes it possible for an installer of the Tool to reuse the software, adaptation techniques, and CTAS-to-Center Host computer interfaces being used in the current CTAS deployment effort. The above description of the method of obtaining and improving the efficiency of trajectories to controllers is only an example of how this invention can be applied and should not be construed as the only application of the invention. The invention is capable of other and different embodiments, and its several details are capable of modifications in various obvious respects, all without departing from the spirit of the invention.

What is claimed is:

1. A method for an automated tool for en route traffic controllers, comprising the steps of:

searching for and identifying tracked aircraft and their associated flight plans and selecting those having one or more direct routes that will reduce the time of flight to the destination; and identifying potential conflicts along the selected one or more direct-to routes wherein the associated flight plans are updated by a controller interface when the one or more tracked aircraft can benefit from the one or more direct routes.

2. The method for an automated tool for en route traffic controllers according to claim 1, wherein selecting those having one or more direct to routes further comprises the step of:

generating four dimensional (4D) trajectories to predict a future position and altitude of the one or more tracked aircraft along a specified route as a function of time, starting at a current time, position and altitude, and terminating at or near a destination airport.

3. The method for an automated tool for en route traffic controllers according to claim 2, wherein selecting those having one or more direct to routes further comprises the step of:

specifying a region of airspace surrounding an enroute center.

4. The method for an automated tool for en route traffic controllers according to claim 3, wherein specifying a region of airspace surrounding an enroute center further comprising the step of:

defining a limit rectangle having limit rectangle parameters which determine a location of a center and dimensions of the limit rectangle chosen by taking into account shape and size of an air traffic control center's airspace.

5. The method for an automated tool for en route traffic controllers according to claim 1, wherein the associated flight plans are updated by a controller interface further comprising the step of:

using a graphical user interface having a Direct-To list appearing as a panel on an air traffic controller's display wherein the graphical user interface includes point-and-click executable commands, and a graphical display of trajectories.

6. The method for an automated tool for en route traffic controllers according to claim 5, further comprising the step of:

providing aircraft call signs within the Direct-To list for the one or more tracked aircraft.

7. The method for an automated tool for en route traffic controllers according to claim 5, further comprising the step of:

providing equipage code and destination-airport identifier within the Direct-To list for the one or more tracked aircraft.

8. The method for an automated tool for en route traffic controllers according to claim 5, further comprising the step of:

providing a field displaying an amount of time savings provided by a direct-to trajectory compared to a currently planned trajectory for the one or more aircraft within the Direct-To list for the one or more tracked aircraft.

9. The method for an automated tool for en route traffic controllers according to claim 5, further comprising the step of:

providing a field within the Direct-To list indicating a conflict status should the selected aircraft follow a proposed direct-to trajectory.

10. The method for an automated tool for en route traffic controllers according to claim 1, further comprising the step of:

providing an field indicating if a direct-to eligible aircraft is in conflict on its current flight plan route.

11. A system for en route traffic controllers, comprising:

means for searching for and means for identifying tracked aircraft and their associated flight plans having one or more direct routes that will reduce the time of flight to the destination; and means for identifying potential conflicts along the identified one or more direct-to routes wherein the associated flight plans are updated by a controller interface when the one or more tracked aircraft can benefit from the one or more direct routes.

12. The system for en route traffic controllers according to claim 11, further comprising:

means for generating four dimensional (4D) trajectories to predict a future position and altitude of the one or more tracked aircraft along a specified route as a function of time, starting at a current time, position and altitude, and terminating at or near a destination airport for means for selecting the one or more direct-to routes.

13. The system for en route traffic controllers according to claim 12, further comprising:

means for specifying a region of airspace surrounding an enroute center for selecting the one or more direct-to routes.

14. The system for en route traffic controllers according to claim 13 further comprising: means for selecting a direct-to fix which lies closer to the boundary of the region of airspace surrounding an en route center for selecting said one or more direct routes.

15. The system for en route traffic controllers according to claim 11, wherein means for specifying a region of airspace surrounding an enroute center further comprising:

means for defining a limit rectangle having limit rectangle parameters which determine a location of a center and dimensions of the limit rectangle chosen by taking into account shape and size of a Center's airspace.

16. The system for en route traffic controllers according to claim 15 further comprising: means for selecting a direct-to fix which lies closest to the boundary of the limit rectangle for direct-to routing, said means chosen by taking into account shape and size of airspace surrounding an en route center for selecting said one or more direct to routes.

17. The system for en route traffic controllers according to claim 11, wherein the associated flight plans are updated by a controller further comprising:

means for using a graphical user interface having a Direct-To list appearing as a panel on an air traffic controller's display wherein the graphical user interface includes means for point-and-click executable commands, and means for graphical display of trajectories.

18. The system for en route traffic controllers according to claim 17, further comprising:

means for providing aircraft call signs within the Direct-To list for the one or more tracked aircraft.

19. The system for en route traffic controllers according to claim 17, further comprising:

means for providing equipage code and destination-airport identifier within the Direct-To list for the one or more tracked aircraft.

20. The system for en route traffic controllers according to claim 17, further comprising:

means for providing a field displaying an amount of time savings provided by a direct-to trajectory compared to a currently planned trajectory for the one or more aircraft within the Direct-To list for the one or more tracked aircraft.

21. The system for en route traffic controllers according to claim 17, further comprising:

means for providing a menu in a trial planning panel of alternate direct-to fixes, each selectable by a point and click action, and providing a time saving or time loss to a selected alternate direct-to fix and a conflict status, and further providing an Accept button in a trial planning panel for executing a direct route flight plan amendment using the selected direct-to fix.

22. A computer product residing on a computer usable medium for optimizing en route traffic control, comprising:

instruction means for searching for and means for identifying one or more tracked aircraft and their associated flight plans;

instruction means for selecting one or more direct-to routes for the one or more tracked aircraft such that their associated flight plans will be reduced in time of flight to a destination; and instruction means for identifying potential conflicts along the selected one or more direct-to routes wherein the associated flight plans are updated by a controller interface when the one or more tracked aircraft can benefit from the one or more direct routes.

* * * * *

UNITED STATES PATENT AND TRADEMARK OFFICE

Certificate

Patent No. 6,314,362 B1

Patented: November 6, 2001

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Heinz Erzberger, Los Altos Hills, CA (US); David McNally, Menlo Park, CA (US); Danny Chiu, Milpitas, CA (US); and Philippe A. Stassart, Los Gatos, CA (US).

Signed and Sealed this Twenty-fourth Day of June 2008.

THOMAS G. BLACK
*Supervisory Patent Examiner*
Art Unit 3661